US011085198B2

(12) United States Patent
Petrenko

(10) Patent No.: US 11,085,198 B2
(45) **Date of Patent: *Aug. 10, 2021**

(54) RETRACTABLE SHELTER

(71) Applicant: Ihor Petrenko, Phoenix, AZ (US)

(72) Inventor: Ihor Petrenko, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/001,675

(22) Filed: Jun. 6, 2018

(65) Prior Publication Data

US 2018/0283031 A1 Oct. 4, 2018

Related U.S. Application Data

(63) Continuation of application No. PCT/US2016/037058, filed on Jun. 10, 2016, which (Continued)

(51) Int. Cl.
*E04H 6/02* (2006.01)
*E04H 6/04* (2006.01)

(Continued)

(52) U.S. Cl.
CPC ..... *E04H 6/04* (2013.01); *E04H 6/025* (2013.01); *E04H 15/36* (2013.01); *E04H 15/38* (2013.01);

(Continued)

(58) Field of Classification Search
CPC ..... E04H 15/02; E04H 15/36; E04H 15/38; E04H 15/54; E04H 15/46; E04H 15/58;

(Continued)

(56) References Cited

U.S. PATENT DOCUMENTS 2,807,058 A * 9/1957 Morgan ..... E05D 15/063 49/409
2,817,344 A * 12/1957 Teeter ..... E04H 15/52 135/129

(Continued)

FOREIGN PATENT DOCUMENTS

CN 2583268 Y 10/2003
CN 101787835 A 7/2010

(Continued)

OTHER PUBLICATIONS

10 Page PDF of a machine translation of CN 101787835, Huo, Zhiwen (Inventor). Zhiwen Huo (Assignee). CN 101787835 A. (Published Jul. 28, 2010). (Year: 2010).*

(Continued)

*Primary Examiner* — Robert Canfield
(74) *Attorney, Agent, or Firm* — Snell & Wilmer L.L.P.

(57) ABSTRACT

A shelter for an automobile has a pair of tracks positioned on opposing sides of the automobile and rest on a supporting surface such as the floor of a garage or car-port. A plurality of frames each having a u-shaped contour extend on opposing sides and over the automobile and are spaced apart from it. The terminal ends the frames are engaged with trucks which are in rolling engagement with the tracks. A canopy of a flexible material is attached over the frames and is movable between a folded state and an unfolded state when the trucks are moved within the tracks. The tracks have mutually orthogonal roller contact surfaces and the trucks have mutually orthogonal rollers positioned for rolling on the roller contact surfaces of said tracks. The canopy is able to be withdrawn from either of opposing sides and is further able to be drawn over the automobile to the supporting surface at both opposing sides.

18 Claims, 6 Drawing Sheets

Related U.S. Application Data is a continuation of application No. 14/960,404, filed on Dec. 6, 2015, now Pat. No. 9,765,545.

(51) Int. Cl.

| | |
|---|---|
| ***E04H 15/36*** | (2006.01) |
| ***E04H 15/46*** | (2006.01) |
| ***E04H 15/48*** | (2006.01) |
| ***E04H 15/54*** | (2006.01) |
| ***E04H 15/38*** | (2006.01) |

(52) U.S. Cl.

CPC ..... *E04H 15/46* (2013.01); *E04H 15/48* (2013.01); *E04H 15/54* (2013.01); *Y10S 135/906* (2013.01)

(58) Field of Classification Search

CPC .. E04H 6/02; E04H 6/04; E04H 6/005; E04H 15/48; B60P 3/40; B60P 7/02; Y10S 135/906

USPC ..... 135/88.13, 88.15, 124, 129, 132–133, 135/136–137, 905, 912; 296/100.12, 296/100.18, 105, 109, 163; 52/66–67; 104/106, 108, 110, 118, 121

See application file for complete search history.

(56) References Cited

U.S. PATENT DOCUMENTS 3,193,870 A * 7/1965 McNinch ..... F16C 29/045 16/97
3,688,787 A * 9/1972 Feather ..... B60J 7/062 135/129
4,693,508 A * 9/1987 Pettit ..... B60J 7/041 296/100.03
4,721,336 A * 1/1988 Jones ..... B60J 7/062 135/129
4,844,109 A * 7/1989 Navarro ..... E04H 6/04 135/129
4,886,083 A 12/1989 Gamache
4,919,054 A * 4/1990 Matsuo ..... B61B 13/08 104/292
5,005,896 A * 4/1991 Li ..... B60J 7/062 135/129
5,310,238 A * 5/1994 Wheatley ..... B60J 7/104 296/100.18
5,443,151 A * 8/1995 Taylor ..... B65G 21/22 104/109
5,538,313 A * 7/1996 Henning ..... B60J 7/065 296/100.12
5,555,695 A * 9/1996 Patsy, Jr. ..... E04H 15/58 52/222
5,740,826 A 4/1998 Nevin
5,921,603 A * 7/1999 Karrer ..... B60P 1/54 296/100.17
6,109,283 A 8/2000 Burke et al.
6,257,260 B1 * 7/2001 Phillips ..... B62D 25/06 135/129
6,269,944 B1 * 8/2001 Taylor ..... B66C 6/00 104/108
6,634,697 B1 * 10/2003 Petelka ..... B60J 7/062 296/100.12
8,171,947 B2 * 5/2012 Hardie ..... E04H 6/04 135/129
8,267,106 B2 * 9/2012 Jordache ..... E04H 15/36 135/129
8,359,994 B1 * 1/2013 Highfield ..... B63B 19/18 114/361
8,967,172 B2 * 3/2015 Ying ..... E04H 15/40 135/129
9,033,393 B2 * 5/2015 Damsi ..... B60J 7/022 296/100.12
9,404,281 B1 * 8/2016 Donnay ..... E04H 15/36
9,744,834 B2 * 8/2017 Damsi ..... B60J 7/022
9,879,457 B1 * 1/2018 Weldon ..... E05D 15/0617
2002/0083971 A1 7/2002 Blount
2002/0093216 A1 * 7/2002 Ananian ..... B60J 7/062 296/100.12
2007/0080557 A1 * 4/2007 Knepper ..... B60J 7/02 296/105
2008/0035010 A1 * 2/2008 McKay ..... B66C 7/04 104/94
2008/0210284 A1 * 9/2008 Dubois ..... E04H 15/38 135/129
2010/0200035 A1 8/2010 Jordache
2010/0282120 A1 * 11/2010 Micheletti ..... B66C 7/08 104/106
2011/0036799 A1 * 2/2011 McKay ..... B66C 9/02 212/312
2012/0048320 A1 3/2012 Hardie
2015/0233139 A1 * 8/2015 Neumann ..... E04H 15/505 135/122

FOREIGN PATENT DOCUMENTS

DE 202005017407 U1 2/2006
FR 2286037 A1 4/1976
GB 981293 1/1965
JP 06002447 A * 1/1994 ..... E04H 6/04

OTHER PUBLICATIONS

PCT; International Search Report and Written Opinion dated Sep. 7, 2016 in the International Application No. PCT/US2016/37058.
Non-Final Office Action in U.S. Appl. No. 14/960,404 dated Dec. 16, 2016.
Notice of Allowance in U.S. Appl. No. 14/960,404 dated Jul. 10, 2017.
Notice of Allowance in U.S. Appl. No. 16/164,690 dated Oct. 23, 2019.
USPTO; Non-Final Office Action in the U.S. Appl. No. 16/164,690 dated Jun. 26, 2019.
China Intellectual Property Administration, First Office Action dated Nov. 29, 2019 in Application No. 201680081034.5.
Office Action dated Aug. 18, 2020 in Chinese Patent Application No. 201680081034.5.
CN; Office Action dated Mar. 12, 2021 in Chinese Application No. 201580081034.5.

* cited by examiner

RETRACTABLE SHELTER

CROSS-REFERENCE TO RELATED APPLICATIONS

This application is a continuation of PCT/US2016/037058 entitled "RETRACTABLE SHELTER" filed on Jun. 10, 2016. PCT/US2016/037058 claims priority to, and the benefit of, U.S. patent application Ser. No. 14/960,404 entitled "RETRACTABLE SHELTER" filed on Dec. 6, 2015. Each of the aforementioned applications is incorporated herein by reference in their entirety for all purposes.

FIELD

The field of this disclosure is adjustable shelters especially for automobiles and other objects and particularly a shelter that has a manually retractable canopy, supported by frames which are movable along tracks so that the canopy does not touch the object stored within.

BACKGROUND

The prior art discloses a wide range of inventive shelters of the type described in the field of this disclosure. Of particular interest is a retractable motor vehicle shelter described in application publication 2010/0200035 of inventors Jordache et al. This shelter provides opposing parallel tracks in which arched poles move to support a canopy. This device is quite complex and uses a motor for automated actuation. A similar device described in application publication 2012/0048320 may be manual or motor driven and uses cylindrical bases for arched ribs supporting a cover. The bases move within hollows in tracks. One drawback of this approach is that the ribs can easily rub against the sides of the tracks causing wear and generating wear-debris.

Other frame supported tent-like enclosures are known in the prior art, but all of the prior art devices are either too flimsy so as to be subject to breakdown and jamming of moving parts, or too complex so that they are too expensive for broad commercial acceptance and also subject to high maintenance costs due to their large number of moving parts.

In contrast to the prior art apparatus, the presently described and illustrated apparatus is structurally robust and uses a new approach in holding and moving supporting canopy frames so that jamming in tracks is not possible, wear is negligible, and manual operation is easily performed as the covering canopy is opened and closed. Furthermore, the design of the disclosed apparatus is relatively inexpensive to produce making it highly attractive commercially.

SUMMARY

A presently described shelter for automobile or other objects uses a pair of spaced apart tracks which rest on a supporting surface such as the floor of a garage or car-port. A plurality of frames each having a u-shaped contour extend over the automobile but are spaced apart from it. The bottom ends of the frames are engaged with trucks which are in rolling engagement within the tracks. A canopy of a flexible material is attached to the frames and is movable between a folded state and an unfolded state in accordance with movement of the trucks and frames. The tracks have mutually orthogonal roller contact surfaces and the trucks have mutually orthogonal rollers positioned for rolling on the roller contact surfaces of the tracks. The canopy is able to be withdrawn from either of opposing ends of the tracks and is further able to be drawn over the automobile to fully enclose it. Ends of the canopy may be lifted to gain access to the engine or truck compartments of the automobile. The canopy may be drawn back to gain access to the driver and passenger compartments. Although similar devices have been conceived a problem has always been that the frames securing the canopy tend to bind in their tracks. Furthermore, prior art concepts tend to be over-engineered with complex mechanism for moving their canopy and other actuations which makes most prior art devices and apparatus too expensive to produce and too subject to breakdown or failure. The presently described shelter uses novel trucks which are inexpensive to produce and easily operated in a smooth manner.

These and other aspects of embodiments herein described will be better appreciated when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated only as examples in the figures of the accompanying drawing sheets wherein the same reference numeral refers to the same element as it may appear in multiple figures and multiple drawing sheets.

DETAILED DESCRIPTION

As shown in the figures, this disclosure describes a shelter 10 which may be used for sheltering an automobile or other object 20. Shelter 10 may rest on a supporting surface 30 (FIG. 1) which may be a garage floor surface, a car-port surface, or any other reasonably flat surface capable of supporting the weight of shelter 10 and object 20.

Figure 1:
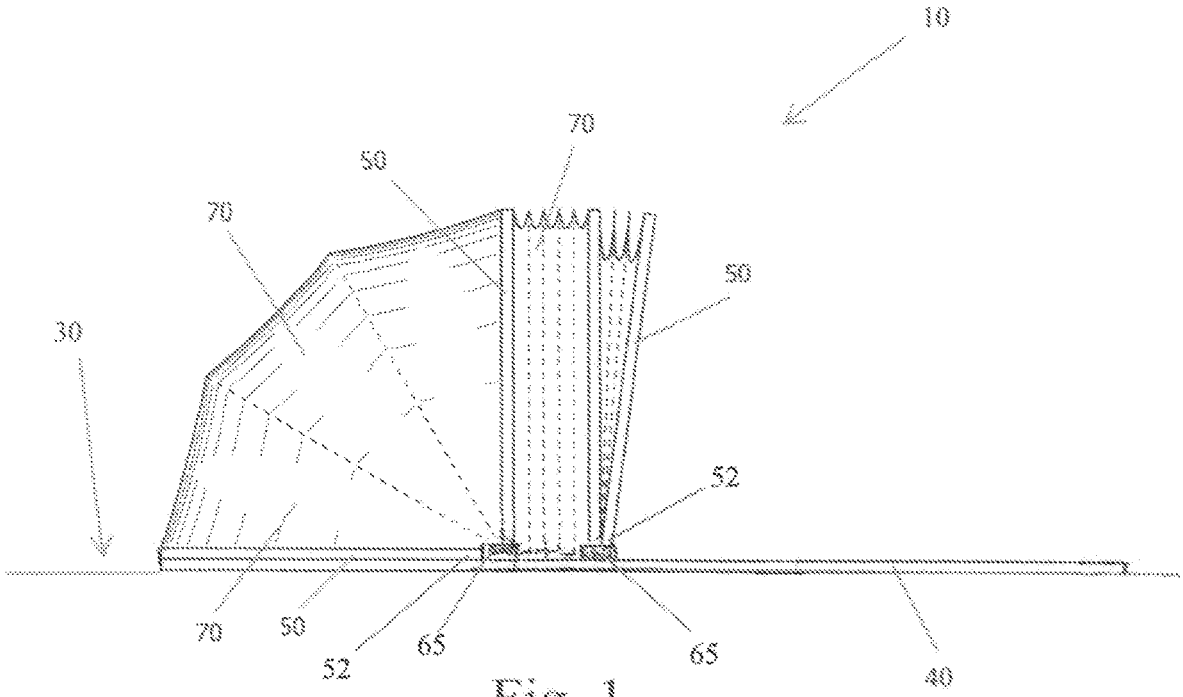
FIG. 1 is a side elevation view of an embodiment of a disclosed shelter showing an open canopy.
Figure 5:
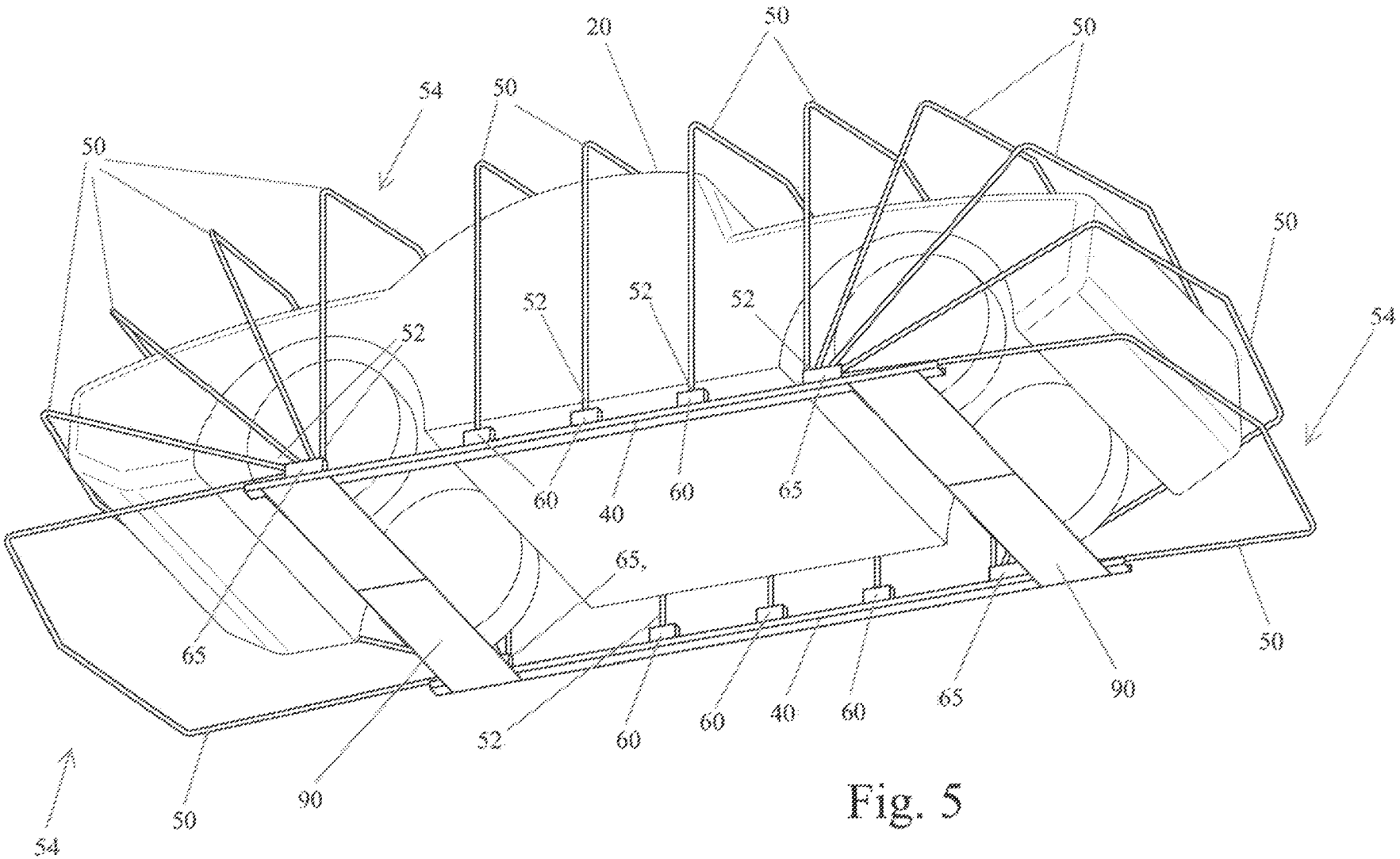
FIG. 5 is a perspective view thereof viewed from below with frames in position to support the canopy (not shown) as in FIG. 4; an automobile is depicted within.

Referring to FIG. 5 it is shown that a pair of tracks 40 are positioned on opposing sides of object 20, and as shown in FIG. 1, tracks 40 rest on surface 30 and may be fastened thereto using common fasteners. A plurality of frames 50 may have a u-shaped contour 54 and may extend over object 20 terminating on opposing sides at tracks 40. Frames 50 may be spaced apart from object 20 as clearly shown in FIG. 5.

Figure 2:
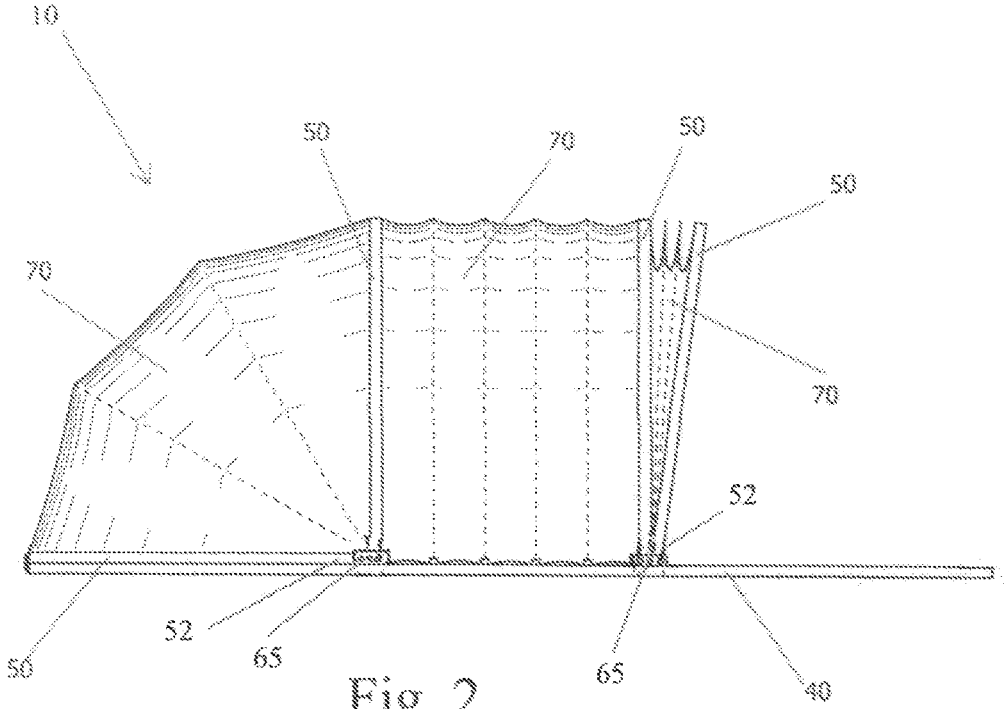
FIG. 2 is a side elevation view thereof with its canopy partially closed.
Figure 3:
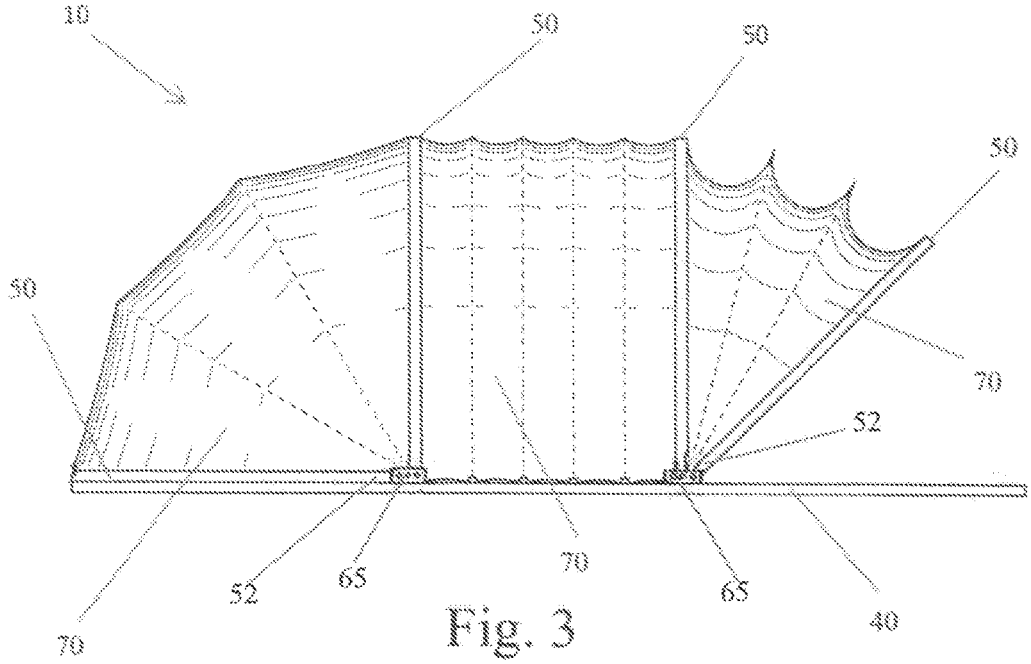
FIG. 3 is a side elevation view thereof shown with its canopy mostly closed.
Figure 4:
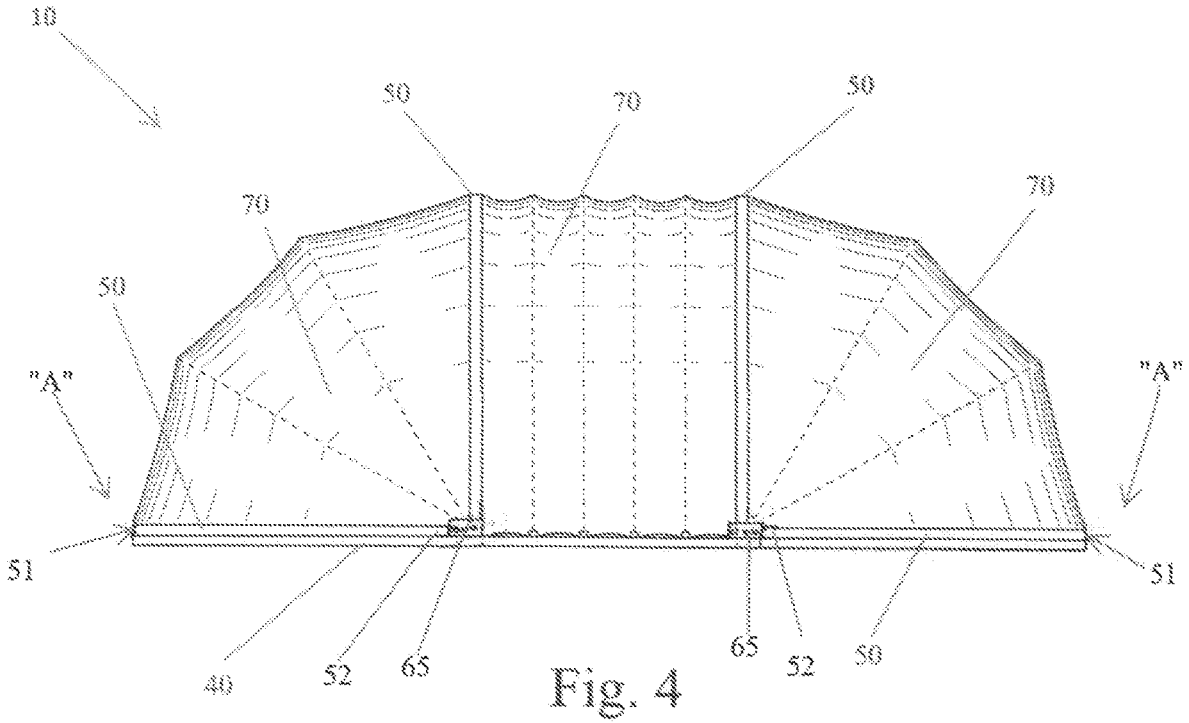
FIG. 4 is a side elevation view thereof shown with its canopy fully closed.

Terminal ends 52 of frames 50 may be engaged with trucks 60 and 65 (FIGS. 8 and 9) wherein trucks 60 and 65 may be engaged with tracks 40 as shown in FIG. 5. Canopy 70 may be of a flexible material such as a canvas fabric and may be attached to frames 50 as shown in FIGS. 1-4, such attachment being by straps of hook and loop material (not shown), or my any other means as known in the art. Canopy 70 together with frames 50 and trucks 60 and 65 may travel between a folded state as shown in FIG. 1, a semi-unfolded state as shown in FIG. 2 and a fully unfolded state as shown in FIGS. 3 and 4. Also, the left side end of canopy 70 (FIG. 1) may be opened to the extend shown in FIG. 2 for the right side end so that only the relatively small extent of canopy 70 shown at the center in FIG. 1 may be left in positioned over object 20 providing maximal access to object 20. The embodiment shown in FIGS. 1-4 teaches that some of frames 50 may be positioned within canopy 70, at the center, while others may be positioned external to canopy 70 such as shown at the left and right side ends. In a preferred embodiment canopy 70 may fully cover all frames 50 as is clear from FIGS. 1-5. In these figures some of frames 50 are depicted by dashed lines and the dashed lines at the left and right ends of canopy 70 represent frames external to canopy 70 while the frames represented by dashed lines at the center section of canopy 70 represent frames 50 within and under canopy 70. FIGS. 1-4 are not intended to represent the dimensions of frames 50 such as their cross-sectional width or diameter, but rather only their approximate overall physical size, and as such, frames 50 may be of any cross-sectional shape, and each one may be one integral piece, or may be made up of several pieces joined together such as is well known with tent poles for instance.

Figure 6:
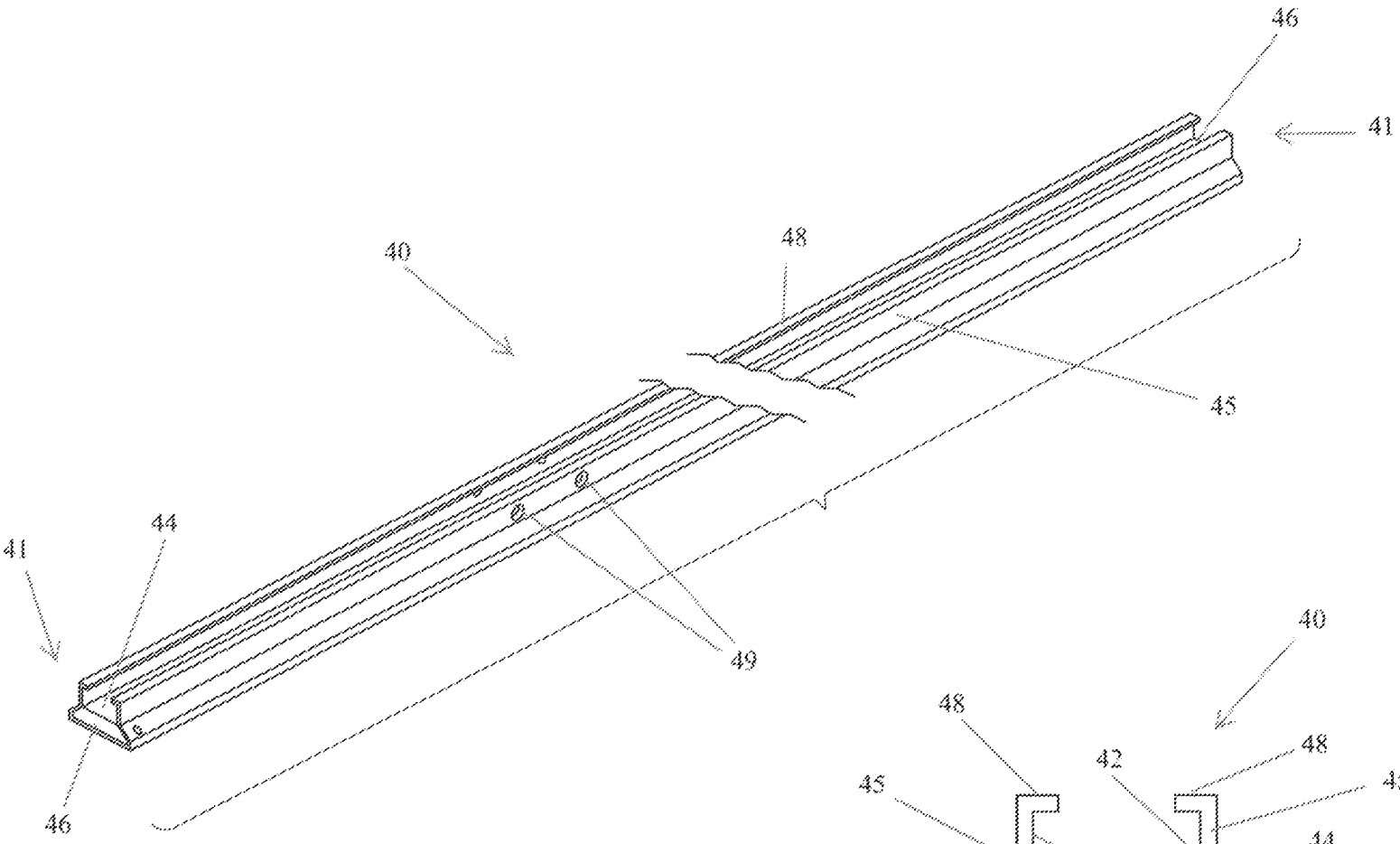
FIG. 6 is a perspective view of a track thereof shown foreshortened.
Figure 7:
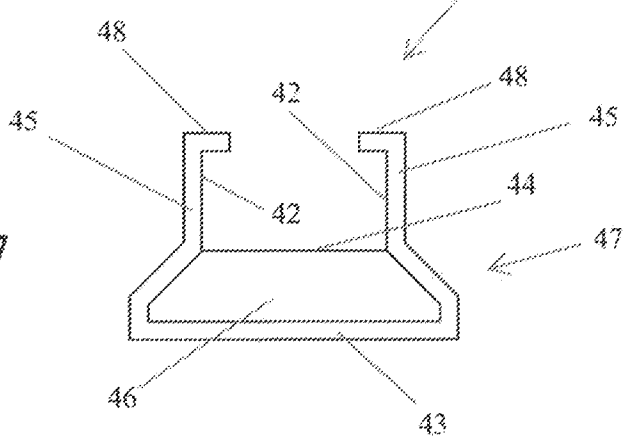
FIG. 7 is an end view of the track of FIG. 6.

Referring to FIGS. 6 and 7 it is shown that in an embodiment, tracks 40 may have a pair of spaced apart longitudinally extensive vertical side walls 45 with opposing interior roller contact surfaces 42 wherein side walls 45 may be joined by a longitudinally extensive horizontal base wall 43. Tracks 40 may be made of extruded steel, aluminum, plastic or other structural materials so that they are longitudinally straight, end-to-end. Tracks 40 may have a trapezoidal base portion 47 as shown. An insert 46 may be placed within track 40 along base portion 47 as shown and may extend its full length as shown in FIG. 6. Track 40 may be made-up of two or more separate pieces laid end-to-end, wherein insert 46 may provide a means for assuring proper joining of the separate pieces. Insert 46 may be shaped as in FIG. 7 so as to fit with friction securement within track 40.

Figure 8:
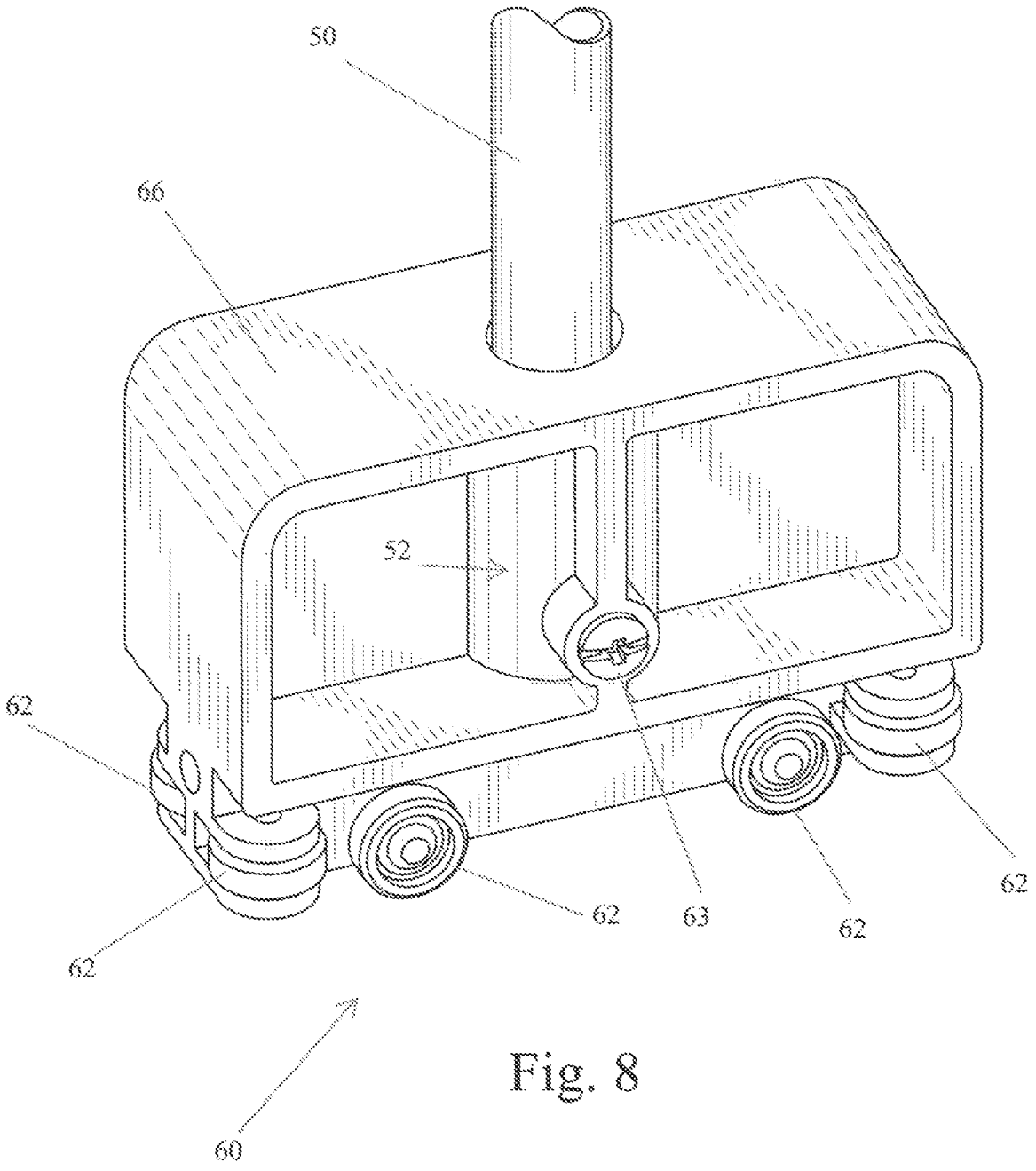
FIG. 8 is a perspective view of a truck of the shelter shown with an end of a frame mounted therein.
Figure 9:
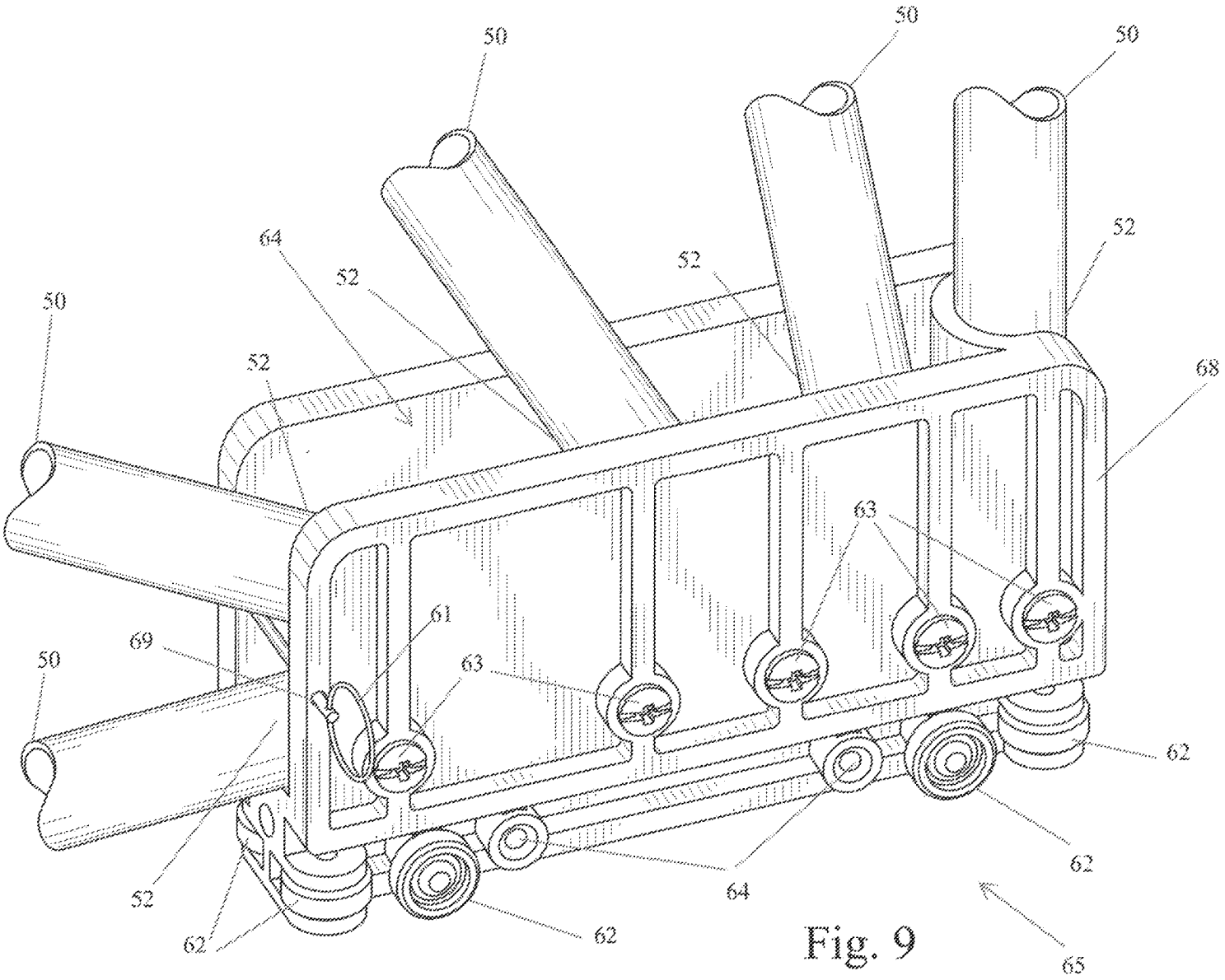
FIG. 9 is a perspective view of a further truck of the shelter shown with ends of a plurality of frames mounted therein.

Trucks 60 and 65, as shown in FIGS. 8 and 9 respectively, may have mutually orthogonal wheels or rollers 62 as shown, which may be positioned and oriented for rolling on roller contact surfaces 42 of insert 46 and roller contact surface 44 when trucks 60 and 65 are inserted into tracks 40. Trucks 60 and 65 have rigid bodies 66 and 68 respectively with rollers 62 being mounted for freely rotating. Bodies 66 and 68 may each have four of rollers 62 oriented vertically and four of rollers 62 oriented horizontally, that is, mutually orthogonal. Of course more than eight rollers 62 may be used with each truck 60, 65. Vertical rollers 62 may extend laterally from opposing sides of bodies 66 and 68 so that when trucks 60 and 65 are engaged within tracks 40, vertical rollers 62 may be positioned below flanges 48 (FIG. 7). Therefore, it may be seen that vertical rollers 62 operate in the vertical space between the undersurfaces of flanges 48 and contact surface 44 and a relatively small tolerance may be allowed in this vertical space so that vertical rollers 62 have space to freely rotate but can prevent trucks 60, 65 from tilting or canting. Furthermore, it can be seen that trucks 60 and 65 can be removed from tracks 40 only at its ends 41 (FIG. 6).

It may be desired to fix trucks 65 at selected positions on track 40, as for instance, so that the top bridging portions 51 of frames 50, when they are laid horizontally, see arrows "A" in FIG. 4, terminate at the end of tracks 40. To accomplish this, holes 49 in tracks 40 may be located longitudinally so that trucks 65 are able to be pinned in place at that location. Trucks 65 have transverse holes 64 which are spaced apart horizontally and located vertically to coincide with holes 49. Pins 61, as for instance of the type shown in FIG. 9, may be used to accomplish securement of trucks 65 in this manner on tracks 40.

As shown in FIG. 9, pin 61 may be placed through holes 69 of body 68 to prevent frame 50 which has been placed into a horizontal attitude, see arrow "A" in FIG. 4, from being lifted or raised by wind forces, for example thereby securing canopy 70 to fully cover object 20. Pin 61 may be removed to allow canopy 70 to be raised, as shown in FIG. 3 in order to gain access to object 20 at one or the other ends of canopy 70. Therefore, when raising or lowering canopy 70 at its ends, trucks 65 may be secured so as to be unable to move on track 40.

Horizontal rollers 62 may be spaced-apart into near contact with both roller contact surfaces 42 so that trucks 60 and 65 are maintained in central positions within tracks 40. Therefore, trucks 60 and 65 are able to easily roll longitudinally within tracks 40. As each pair of trucks 60 move within tracks 40 their connected frame 50 moves with them and maintains its vertical posture as shown in FIGS. 1 and 2. The connecting frames 50 move with trucks 60 and 65 and are able to maintain their near vertical posture as shown in FIGS. 1 and 2 and also are able to rotate away from the vertical as shown in FIGS. 3 and 4. When one truck 60 or 65 is forced to progress along track 40 ahead or behind its truck pair, horizontal rollers 62 tend to take up this distortion preventing binding of the trucks with track 40. Because rollers 62 are in contact with track 40 binding between truck 60, 65 and track 40 is prevented even when strong distorting forces are applied to frames 50. During normal manual opening and closing of canopy 70 smooth operation is experienced.

As shown in FIG. 5 a compliment of trucks may include pairs of first trucks 60 and pairs of second trucks 65, the pairs engaged with opposing tracks 40. Each pair of first trucks 60 may be engaged with a single one of frames 50 which is fixed in a vertical orientation, see FIG. 8. Each pair of second trucks 65 may be engaged with plural frames 50 in a hinged manner as hinge rods 63 extend through the lower portions 52 of frames 50, thereby allowing rotation over a range of angles positioning frames 50 from near vertical to fully horizontal, as shown in FIG. 5. To accomplish this, truck 65 has an open structure referenced by numeral 64.

Tracks 40 may be joined by a transverse element 90 securing tracks 40 in mutually parallel positions as shown in FIG. 5 so that the lower legs of frames 50 on opposing tracks 40 do not converge or diverge as trucks 60 and 65 move along tracks 40. Transverse element 90 may be fastened to tracks 40 using common hardware and may be any rigid element but preferably in the form of a strip, or a rod for instance.

In an embodiment, object 20 may be a vehicle such as an automobile as shown in FIG. 5 wherein frames 50 and canopy 70 are spaced apart from the vehicle so as not to scratch it. Object 20, may be anything that one desires to shelter from dust, sand, dirt, the outdoor elements, and so on, but shelter 10 is ideal for sheltering an automobile as it allows flexibility in gaining access to both ends of canopy 70 and allows nearly full withdrawal as well so as to gain maximum access to sheltered object 20.

In the foregoing description, embodiments are described as a plurality of individual parts, and methods as a plurality of individual steps and this is solely for the sake of illustration. Accordingly, it is contemplated that some additional parts or steps may be added, some parts or steps may be changed or omitted, and the order of the parts or steps may be re-arranged, while maintaining the sense and understanding of the apparatus and methods as claimed.

What is claimed is:

1. A shelter comprising:

a parallel pair of spaced apart tracks for resting on a supporting surface, wherein the tracks comprise:

a base wall, a pair of spaced apart walls extending perpendicularly from the base wall to a pair of ends of the pair of spaced apart walls, a pair of angled spaced apart walls extending, from the pair of ends of the pair of spaced apart walls, at an angle inclined towards each other and away from the base wall, to a pair of ends of the pair of angled spaced apart walls, a pair of spaced apart side walls extending, from the pair of ends of the pair of angled spaced apart walls, perpendicularly away from the base wall, to a pair of ends of the pair of spaced apart side walls, and a pair of flanges extending towards each other, parallel to the base wall, from the pair of ends of the pair of spaced apart side walls;

a plurality of frames extending between the tracks, each one of said frames having opposing terminal ends;

wherein, said terminal ends of said frames are engaged with trucks, said trucks engaged with said tracks; and a canopy attached to said frames, said canopy movable between a folded state and an unfolded state in response to a translation of said trucks;

wherein said tracks each have a first contact surface and a second contact surface configured to retain said trucks within said tracks;

wherein each one of said trucks contacts the respective first contact surface and second contact surface and, in response to the contact, is configured to translate along an axis parallel to the respective track, and wherein each one of said trucks comprises a first roller and a second roller, wherein the first roller contacts the first contact surface and the second roller contacts the second contact surface.

2. The shelter of claim 1, wherein each flange of the pair of flanges extends orthogonal to the respective first contact surface.

3. The shelter of claim 1, wherein the first contact surface and the second contact surface are mutually orthogonal.

4. The shelter of claim 1, wherein said first roller rolls in contact with one of said pair of spaced apart side walls and wherein second roller rolls in contact with a roller contact surface of an insert supported by the base wall.

5. The shelter of claim 1, wherein said trucks include pairs of first trucks and pairs of second trucks, wherein each pair of first trucks are engaged with one of said plurality of frames and wherein each pair of second trucks are engaged with more than one of said plurality of frames.

6. The shelter of claim 5, wherein each one of said frames engaged with said pair of said first trucks is fixed in an approximately vertical orientation.

7. The shelter of claim 6, wherein each one of said plurality of frames engaged with said second trucks are rotatable over a range of angles relative to said tracks.

8. The shelter of claim 7, wherein one of said frames is rotatable between an approximately vertical orientation and an approximately horizontal orientation.

9. The shelter of claim 1, further comprising a transverse element coupled between the tracks configured to retain the tracks with respect to the supporting surface.

10. A combination comprising:

a sheltered object for resting on a supporting surface;

a pair of tracks positioned on opposing sides of said sheltered object, said pair of tracks for resting on said supporting surface, wherein the tracks comprise:

a base wall, wherein the base wall is contacted with the supporting surface;

a pair of spaced apart walls extending perpendicularly from the base wall to a pair of ends of the pair of spaced apart walls, a pair of angled spaced apart walls extending, from the pair of ends of the pair of spaced apart walls, at an angle inclined towards each other and away from the base wall, to a pair of ends of the pair of angled spaced apart walls, a pair of spaced apart side walls extending, from the pair of ends of the pair of angled spaced apart walls, perpendicularly away from the base wall, to a pair of ends of the pair of spaced apart side walls, and a pair of flanges extending towards each other, parallel to the base wall, from the pair of ends of the pair of spaced apart side walls;

a plurality of frames extending between the tracks and over said sheltered object, each one of said frames having opposing terminal ends; and wherein, said terminal ends of said frames are engaged with trucks, said trucks engaged with said tracks;

a canopy attached to said frames, said canopy movable between a folded state and an unfolded state in response to a translation of said trucks;

wherein said tracks each have a first contact surface and a second contract surface configured to retain said trucks within said tracks;

wherein each one of said trucks contacts the respective first contact surface and second contact surface and, in response to the contact, is configured to translate along an axis parallel to the respective track, and wherein each one of said trucks has a pair of first rollers and a pair of second rollers, said first rollers spaced apart in a first direction and said second rollers spaced apart in a second direction wherein said first and second directions are mutually orthogonal.

11. The combination of claim 10, wherein each flange of the pair of flanges extends orthogonal to the respective side wall of the pair of spaced apart side walls.

12. The combination of claim 11, wherein said pair of first rollers are oriented for rolling in contact with said pair of spaced apart side walls, respectively, and wherein said pair of second rollers are oriented for rolling contact with a roller contact surface of an insert supported by the base wall.

13. The combination of claim 10, wherein said trucks include pairs of first trucks and pairs of second trucks, wherein each pair of first trucks are engaged with one of said plurality of frames and wherein each pair of second trucks are engaged with plural of said plurality of frames.

14. The combination of claim 13, wherein each one of said frames engaged with said pair of said first trucks is fixed in a vertical orientation.

15. The combination of claim 10, wherein one of said frames is rotatable between an approximately vertical orientation and an approximately horizontal orientation.

16. The combination of claim 10, wherein said tracks are joined by a transverse element coupled between the tracks and configured to retain the tracks with respect to the supporting surface.

17. The combination of claim 10, wherein said sheltered object is a vehicle and wherein said frames and said canopy are spaced away from said vehicle.

18. The combination of claim 17, wherein said vehicle is an automobile.

* * * * *